United States Patent [19]

Erhart

[11] 4,014,151

[45] Mar. 29, 1977

[54] COUPLING STRUCTURE WITH ANCHORING IN STONE PARTS

[75] Inventor: Dieter Erhart, Memmingerberg, Germany

[73] Assignee: Mannesmann Leichtbau, GmbH, Munich, Germany

[22] Filed: June 1, 1976

[21] Appl. No.: 691,334

Related U.S. Application Data

[63] Continuation of Ser. No. 582,675, June 2, 1975, abandoned, and a continuation of Ser. No. 372,155, June 21, 1973, abandoned.

[52] U.S. Cl. ..... 52/587; 52/125; 52/235; 52/513; 52/710; 403/121; 403/353

[51] Int. Cl.[2] ..... E04G 21/12

[58] Field of Search ..... 52/125, 235, 513, 587, 52/710; 403/121, 353

[56] References Cited

UNITED STATES PATENTS

| | | | |
|---|---|---|---|
| 1,350,964 | 8/1920 | Friel | 52/709 X |
| 1,708,091 | 4/1929 | Healy | 52/709 |
| 1,831,416 | 11/1931 | Junkers | 403/52 |
| 2,078,144 | 4/1937 | Kenan | 52/583 X |
| 3,096,831 | 7/1963 | Adams | 403/331 X |
| 3,124,385 | 3/1964 | Neptune | 52/711 X |
| 3,233,319 | 2/1966 | Jensen et al. | 403/353 X |

FOREIGN PATENTS OR APPLICATIONS

| | | | |
|---|---|---|---|
| 1,684,278 | 3/1971 | Germany | 52/125 |
| 1,275,754 | 8/1968 | Germany | 52/484 |

*Primary Examiner*—Alfred C. Perham
*Attorney, Agent, or Firm*—Ralf H. Siegemund

[57] ABSTRACT

Coupling structure for artificial stone parts such as concrete plates etc., have an anchoring member partially embedded in the stone with a head projecting therefrom and releasably inserted in a coupling member of C-shaped cross-section e.g. for suspension but permitting limited turning on an axis longitudinal to the C-groove of the coupling member, so that lateral forces are reacted into the anchoring member. Additional features include support flanges on the anchoring member; bent off portions of the anchoring member with additional members; wire loops for improving anchoring; and special bayonet-like insertion and locking of the head in a particular type coupling member.

11 Claims, 18 Drawing Figures

VIEW A

Fig. 8
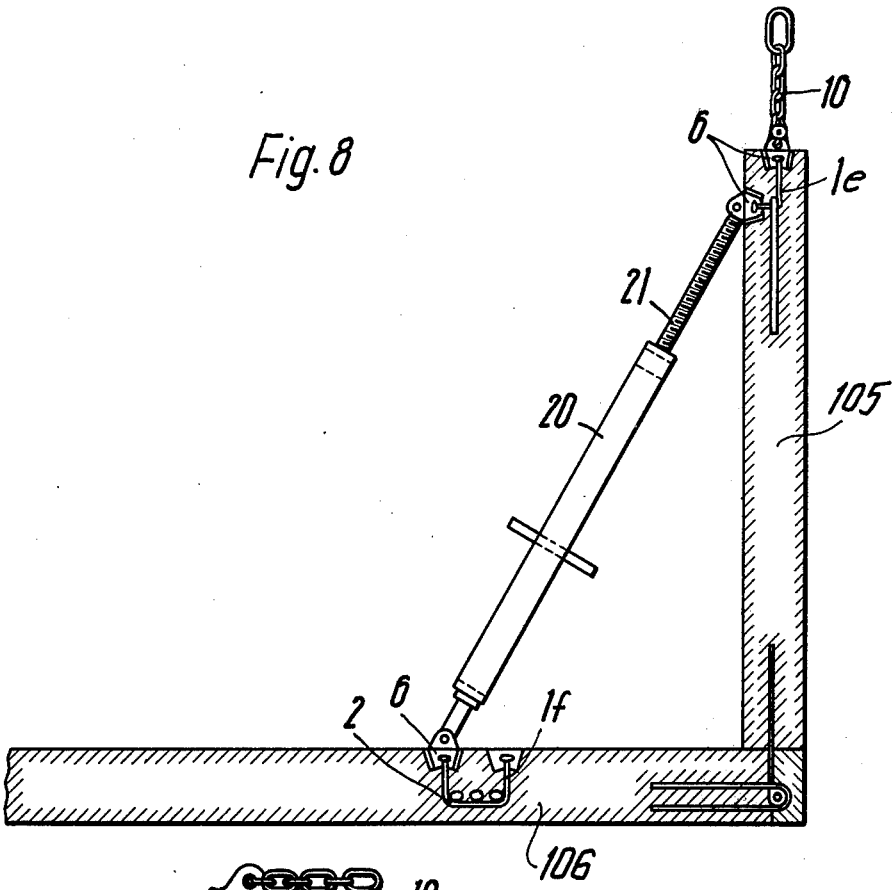
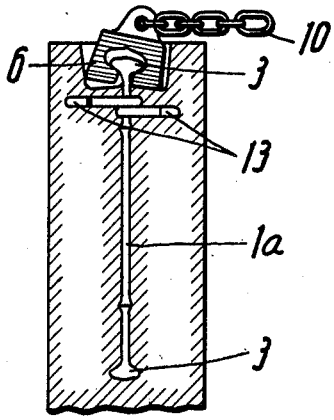
Fig. 9
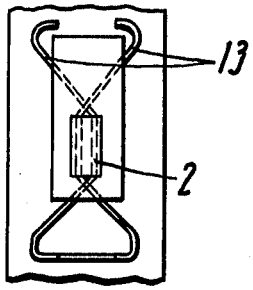
Fig. 10

COUPLING STRUCTURE WITH ANCHORING IN STONE PARTS

This is a continuation of application Ser. No. 582,675, filed June 2, 1975, now abandoned, and a continuation of Ser. No. 372,155, filed June 21, 1973, now abandoned.

BACKGROUND OF THE INVENTION

The present invention relates to coupling arrangements on parts made of artificial stone material such as concrete, for transporting, moving and positioning such parts.

Stone plates made of concrete have to be suspended for example for transport as well as upon installation. For this, anchoring pins or bolts have usually been embedded in the stone material and secured therein upon hardening of the material. These pins or bolts are then connected to suitable transport equipment such as by means of threaded fastenings, ropes, hoists, etc. whereby usually special equipment is needed and provided for.

The German printed patent application DAS 1,684,278 describes a known variety of anchoring arrangements with pins. The shank of that anchoring pin is omni-directionally widened to constitute a connecting head, while the connecting piece proper is crown-shaped and is provided with a longitudinal groove which curves in longitudinal direction and is open at one end. The cross-section of that groove matches the shape of the said head in an undercut configuration.

This particular known device permits suspension of concrete parts by means of suitable hoisting equipment. These and other generally known suspension arrangements for concrete parts have the particular feature that tension in direction of the axis of the embedded bolt or pin is indeed reacted into the surrounding concrete. However, these known arrangements have the decided disadvantage, that forces not in line with pin's axis tend to crack that portion of the concrete which embeds and surrounds the pin. Moreover, the dimensions of the anchoring pin are determined by the weight of the respectively suspended part so that for differently heavy parts one needs different kinds of anchoring bolts and pins etc., which is expensive because of the large inventory needed to accommodate the large variety of needs.

SUMMARY OF THE INVENTION

It is an object of the present invention to provide for a suspension and support assembly for stone plates of the like which does not have the deficiencies outlined above.

It is a particular object of the present invention to provide for an arrangement which can serve for suspension of concrete and other stone plates under all relevant circumstances including transportation generally, but also for moving, positioning and orienting such plates during final installation.

It is another object of the present invention to provide releasable coupling structure between an anchoring facility embedded in such stone parts, and a coupling structure, whereby the former is to be constructed to avoid uneven edge compression of the anchored part, so as to avoid cracking of the stone material, particularly when tension forces are exerted with a component in a direction transverse to the axis of normal suspension.

It is a further object of the invention to provide for improvements in the embedding of an anchoring facility in stone to avoid unnecessarily complicated encasing of any coupling part when to be anchored in the stone material.

In accordance with the preferred embodiment of the invention, suspension arrangement as suggested having the following features. An anchoring member is comprised of a ridge or bar with at least one elongated, profiled head having a convexly bulging contour of a surface portion adjacent the ridge as projecting from the head; a coupling and suspension member is provided with C-shaped cross-section, and having edge portions facing each other but clearing the ridge of the anchoring member when the head thereof is received in the space as partially circumscribed by the C-cross-section of the member; the edge portions of the suspension member have concavely curved shoulders corresponding to and for engagement with the convexly profiled and contoured surface portions of the head of an inserted anchoring member; the respective shoulder of the member as running towards the bar or ridge of an inserted anchored member have an angle of more than 90° relative to the direction of extension of the flanges that constitute the legs of the C of the coupling member.

In the preferred form, the coupling and suspension member has its cavity closed laterally to one side so that the anchoring head be slid into position in the cavity from the other side only. The particular cavity may even be closed from all sides except from below with particular contour of the shoulder edges that permits insertion of the anchoring head and turning thereof for locking.

The anchoring member has preferably another head which may be embedded for reinforcing the anchoring in the stone material. However, the second head may project also out of the stone so as to have two heads available as coupling elements. Preferably, the two heads serve for coupling to coupling members serving different purposes such as suspension for transport, erection on site for final installation and final positioning etc.

In addition or in lieu of an embedded head, the embedding of the anchoring member may be secured further by means of anchoring parts tied around or passing through the ridge of the anchoring member, inside of the stone material and extending laterally away from the depths and anchoring direction of the ridge as extending into the materials. This feature is particularly of advantage for thin stone plates.

It should be noted that not just the head but to some extent also the bar or ridge of the anchoring member projects from a surface of the stone material. It needs to project only to the extent necessary for accommodating the edges of the respective suspension member. In order to define that latter space more definitely, the anchoring member is preferably provided with flanges extending from the ridge in opposite directions and below the head. These flanges are flush with the surface of the concrete.

The flanges may extend straight from the ridge or bar of the anchoring member, but preferably the flanges are then bent up or curved up to a level at least as high as the down facing (convexly contoured) surface of the head. The space provided for insertion of the edge portions of the coupling member will be protected against inflow of not yet solidified stone material, e.g. soft concrete, without requiring special encasing. Also, the flanges serve as action surface for engagement with the coupling member, if laterally directed forces act on the coupling member.

A special construction permits coupling engagement from the top rather than laterally and a partially oblique arrangement of coupling member ridges permits disengagement and engagement of the anchoring head upon turning in one or the other direction in the bayonet like construction. Additional locking means secure the coupling member to the anchoring member.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which

FIG. 8 is a section view through stone plates oriented and positioned with equipment using the inventive coupling arrangement;

FIG. 9 is a section view through another and FIG. 10 is a top view with relevant phantom lines showing additional anchoring.

FIGS. 12 and 13 are respectively section views respectively designated by lines AB and CD in FIG. 11.

Figure 1:
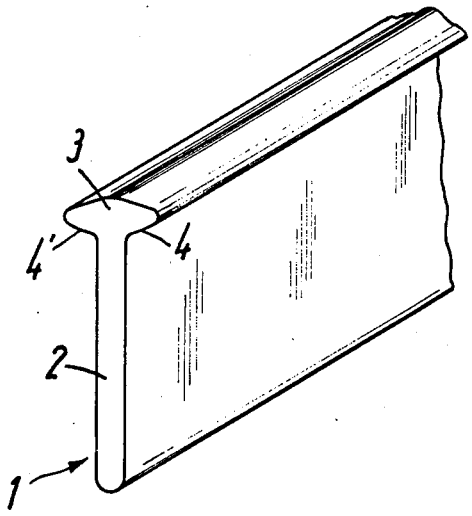
FIG. 1 is an isometric view of the most simple form for an anchoring member as used in a coupling assembly in accordance with the preferred embodiments of the invention.
Figure 2:
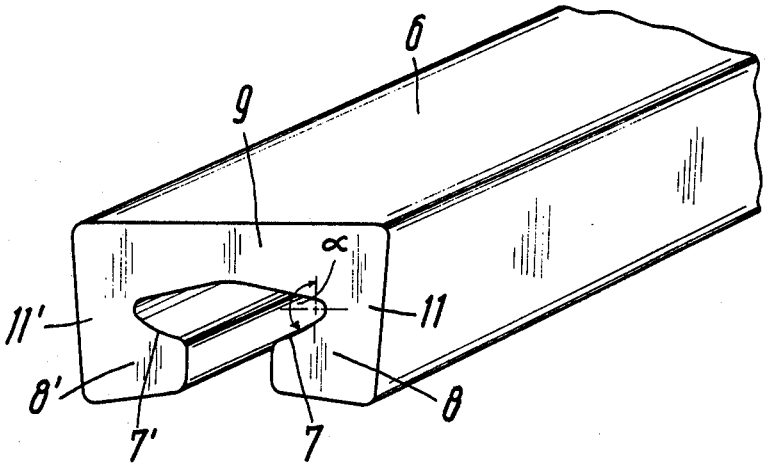
FIG. 2 is an isometric view of a coupling and suspension member for coaction with a member shown in FIG. 1.

Proceeding now to the detailed description of the drawings, reference is made first for FIGS. 1 and 2 showing the salient components for the assembly in accordance with the preferred embodiment of the invention. Turning first to FIG. 1 showing an anchoring member 1 with a ridge 2 and a profile head 3; the ridge as well as the head are of elongated extension in the isometric direction. The length of anchoring member 1 may be differently chosen for various purposes but the member is always longer than the head is wide.

There are two surfaces 4 and 4′ of head 3 from which the 2 emerges and projects, and these surfaces 4 and 4′ are convexly curved to constitute bulging engagement surfaces for particular coaction with a coupling and suspension member.

FIG. 2 shows a coupling member 6 which is a C-profile section of particular configuration. Coupling member 6 has a base 9 from which extend flanges 11 and 11′ generally transverse to the base in the cross-section but at an angle of less than 90° therewith. Lips or edges 8 and 8′ respectively extend from flanges 11 and 11′ towards each other and leaving a space between them which is sufficiently wide for receiving the ridge 2 of an anchoring member, but that clearance is narrower than the width of a head 3 of such an anchoring member. Edges 8 and 8′ have inner shoulders 7 and 7′ respectively, which are concavely contoured in the cross section plane, and they extend at an angle $\alpha$ larger than 90° from the respective flanges 11, 11′.

Figure 3:
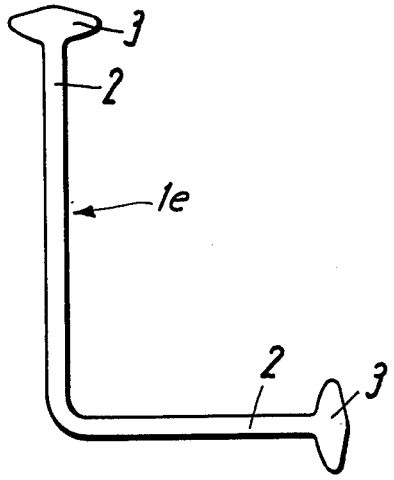
FIGS. 3 and 4 show double head anchoring members respectively with one and two angle ridges.
Figure 4:
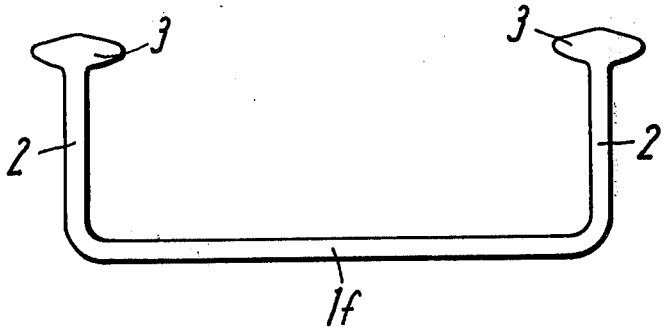

FIGS. 3 and 4 show anchoring members with two heads and ridges which are angled, once in FIG. 3, twice in FIG. 4.

Figure 5:
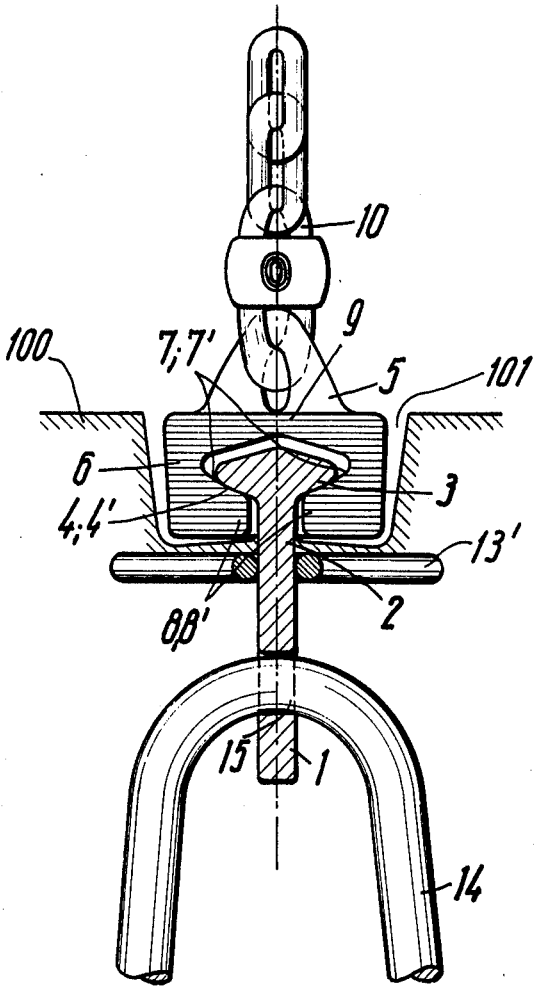
FIG. 5 is a section view of a coupling arrangement using an anchoring member as shown in FIG. 1 and a suspension member as shown in FIG. 2.

A complete assembly of parts such as shown in FIGS 1 and 2 is illustrated in FIG. 5. Reference numeral 100 denotes a concrete part into which a ridge 2 has been case for partial embedding of an anchoring member in the concrete. The head 3 of the member 1 is exposed in a groove 101 of part 100. Ridge 2 is provided with a bore 15 traversed by a bent or curved rod 14 for better anchoring member 1 in the concrete. A wire 13′ loops aditionally around the ridge and projects into the concrete for further anchoring.

A coupling and suspension member 6 is provided for receiving the head of member 1. The upper portion of ridge 2 traverses the slot between the two lips or edges 8, 8′. A hook or eye member 5 is secured to the outer surface of base 9 of member 6, and this eye 5 is linked for example to a chain 10. Hook or eye 5 is a permanently connected or even integral part of coupling member 6 and serves generally for providing for releasable connection to equipment which suspends, supports, positions or holds otherwise the stone part in which the anchoring member 1 is secured and embedded.

Normally, pulling force is exerted by the chain vertically upon coupling member 6, which will be the case particularly when the concrete part 100 is freely suspended. If, however, part 100 is additionally supported from below or abuts a stop anywhere, then the force interaction as effective on the coupling member 6 may have lateral components. Under such circumstances convexly budging surface portions 4 and 4′ of the head 3 shift or roll on the concavely shaped choulders 7 and 7′ and vice versa and about an axis which is a longitudinal axis of the groove or receiving space (C-profile) of the coupling member. Turning is limited when the down facing surface of one of the edges 8 or 8′ abuts the concrete at the bottom of groove 101 in stone part 100. This way, lateral forces on member 6 are reacted into the concrete without danger of cracking the concrete near the zone of embedding.

One can, therefore, see that the head 3 should project above this bottom surface of groove 101 for a height not less and not much more than the short dimension of the ends of edge of lips 8, 8′ so that one or the other thereof can firmly grip unde the head, right where ridge 2 projects, while this particular gripping edge sits and acts on the concrete in a direction normal to the bottom surface i.e. in parallel to the down direction of anchoring.

Figure 6:
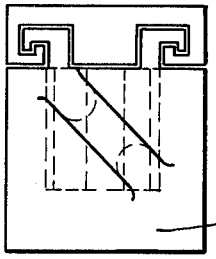
FIG. 6 is a view as indicated by arrow A in FIG. 7.
Figure 7:
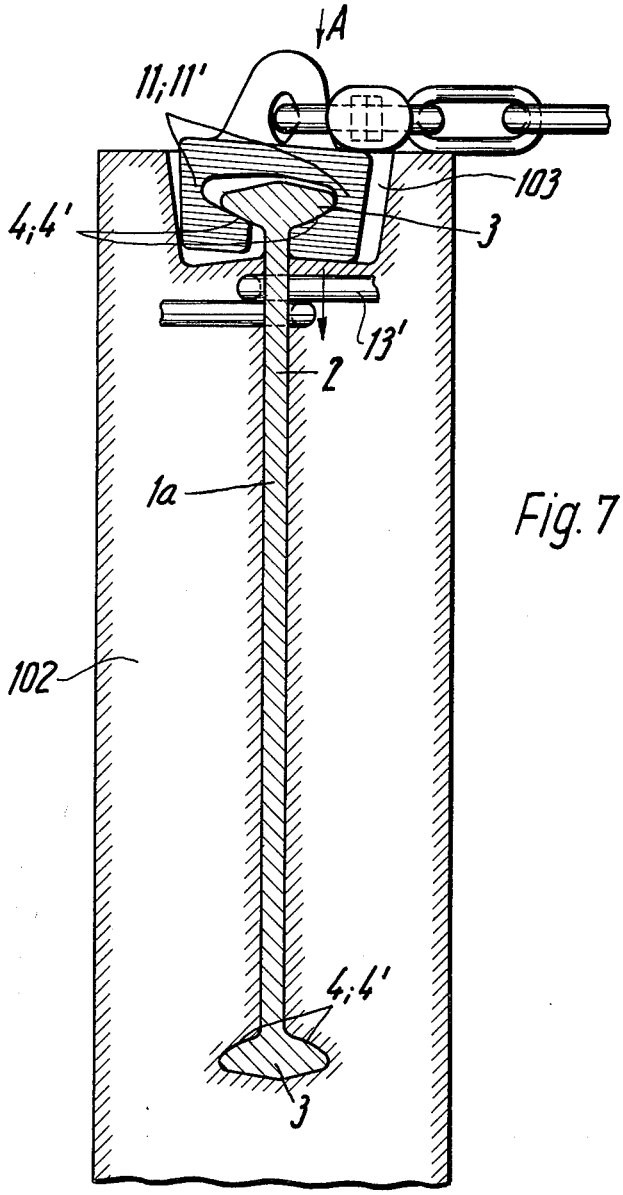
FIG. 7 is a section view through another coupling arrangement with a twin head anchoring member.

FIGS. 6 and 7 show another example of the preferred embodiment of the invention. The particular anchoring member 1a is provided with two profile heads, one of which being fully embedded in the interior of a concrete plate 102. This way, one does not need the additional anchoring means 14 shown in FIG. 5. However, employment of a wire loop 13' for anchoring ridge 2 close to the surface of the concrete is still advisable, and is actually a rather simple but quite effective feature as it does not involve machining of the anchoring member 1 itself. The ridge 2 is shown to extend straight down here but could be angled, but only if the 102 were thicker.

FIG. 6 shows further that the hook or eye on member 6 is preferably obliquely positioned, and member 6 has one side of the groove closed as circumscribed and defined in its C-shaped contour. The closing is established by the transverse wall 12. The chain is shown here as exerting pulling force laterally to the vertical direction of suspension, and one can readily see from FIG. 7 how the suspension member has taken up a slightly askew position in which edge 8' bears against the short portion of ridge 2 as projecting from the concrete mass, and the down directed surface of ridge 8' rests on the concrete bottom of the groove 103 in plate 102, for reacting a force component into the concrete as indicated by the arrow.

FIGS. 9 and 10 show additionally how an anchoring member be anchored additionally in the concrete for better distributing external forces exerted on the member. Particularly constructed loop members 13 embrace the ridge 2 of member 1 and provide for additional anchoring in the embedding concrete.

The Figures previously discussed emphasized the immediate interaction between anchoring and suspension members, FIG. 8 shows a larger assembly with plural anchoring and plural suspension members. For example, a concrete plate 105 has embedded an anchoring member 13 of the type shown in FIG. 3; that particular member has two heads and both heads emerge from the concrete, but they face in different directions i.e. they pass through differently directed surface portions of the concrete plate 105 because the two heads serve two different coupling functions.

One of these heads engages a coupling member 6 to which a chain 10 is linked for suspending the plate 105 when suspension is needed. The other anchoring head is also engaged with a coupling member 6 but the latter member is hinged to a spindle 21 of a bracing support 20. The other (lower) end of bracing device 20 is hinged to another coupling member 6 which is coupled to the head of an anchoring member 1f of the type shown in FIG. 4. The latter anchoring member 1f is embedded in a second concrete plate 106. This particular assembly serves as a positioning arrangement for positioning and/or holding plate 105 upright on and in relation to plate or base 106.

Figure 11:
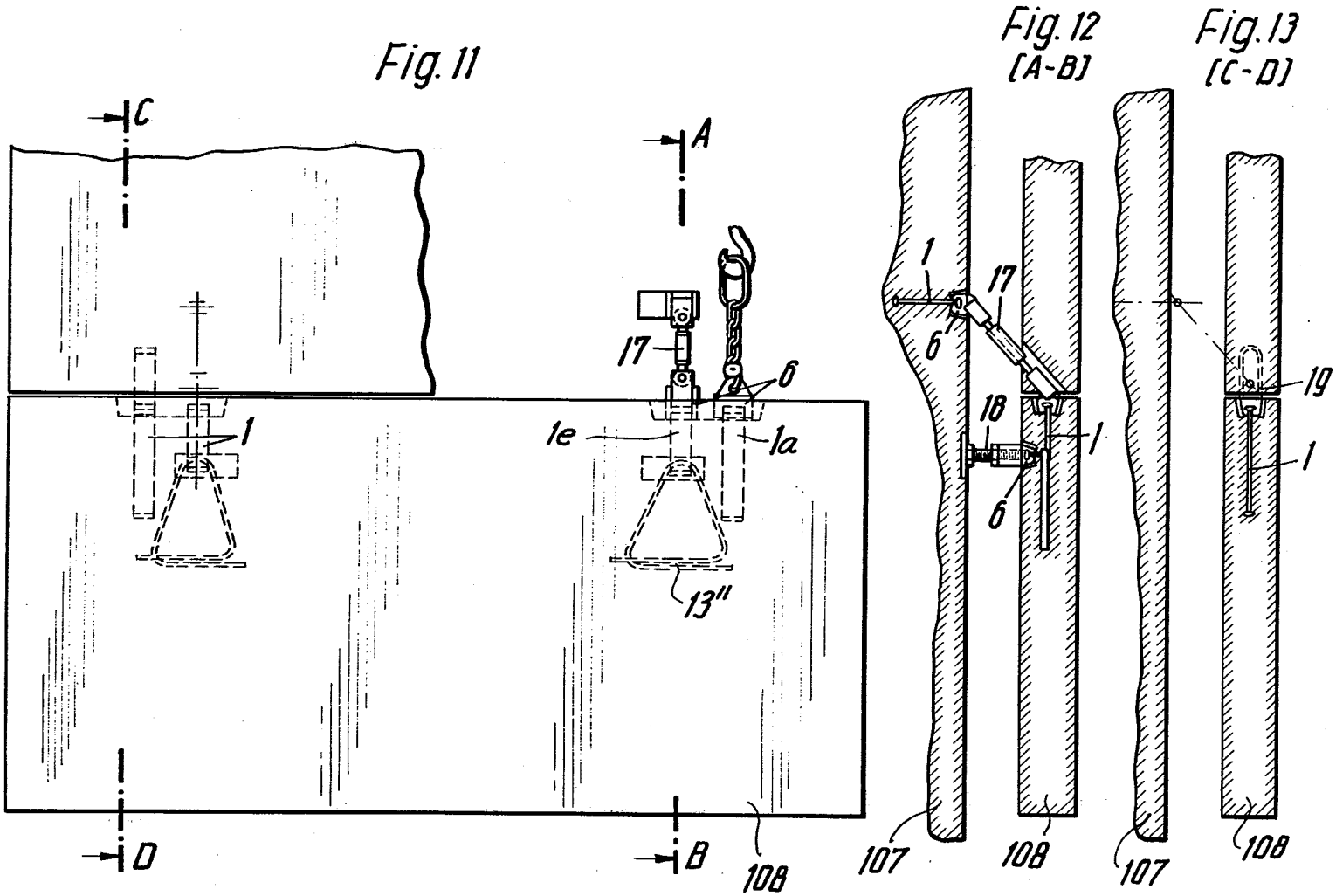
FIG. 11 shows position and suspension of sidings using coupling structure in accordance with the invention and for different purposes.

FIGS. 11, 12 and 13 demonstrate further uses of the invention, particularly as far as final anchoring and installation of concrete sidings is concerned. The figures show a wall 107 of a building and siding plates 108 are to be secured to that building. The sidings 108 are suspended by means of equipment 17 hinged to a siding 108 through one of the inventinve couplings. Each end of suspension 17 is hinged or otherwise linked to a coupling member 6 which in turn receives a head of an anchored member, one being embedded in aiding 108, another one being secured to and in the wall 107.

The sidings may be placed at a distance from the wall by means of a spacer 18. At least one end of spacer 18 is provided with a coupling member 6 which is coupled to the head of an anchoring member as embedded also in siding 108. The other end of spacer 18 may simply bear against the wall.

One can see particularly from FIG. 12 that an elbow bent anchoring member 1e of the type shown in FIG. 3 has been used in the upper portion of plate 108. The upper head couples to that particular coupling member 6 which is secured to suspension equipment 17, while the leftwardly angled head is coupled to the member 6 that pertains to spacer 18. The particular member 1e is shown here to be additionally anchored by a wire loop 13''.

FIG. 11 shows additionally and on the right hand side thereof that one of the sidings may have been or still is connected to a chain via a separate coupling arrangement. The particular anchoring member 1a has also a second head, but that head extends straight down and is deeply embedded in the siding, just as is shown in greater detail in FIGS. 7 and 9. FIG. 11 in conjunction with FIG. 13 shows also that the principle of the invention can be used to couple sidings to each other.

Figure 14:
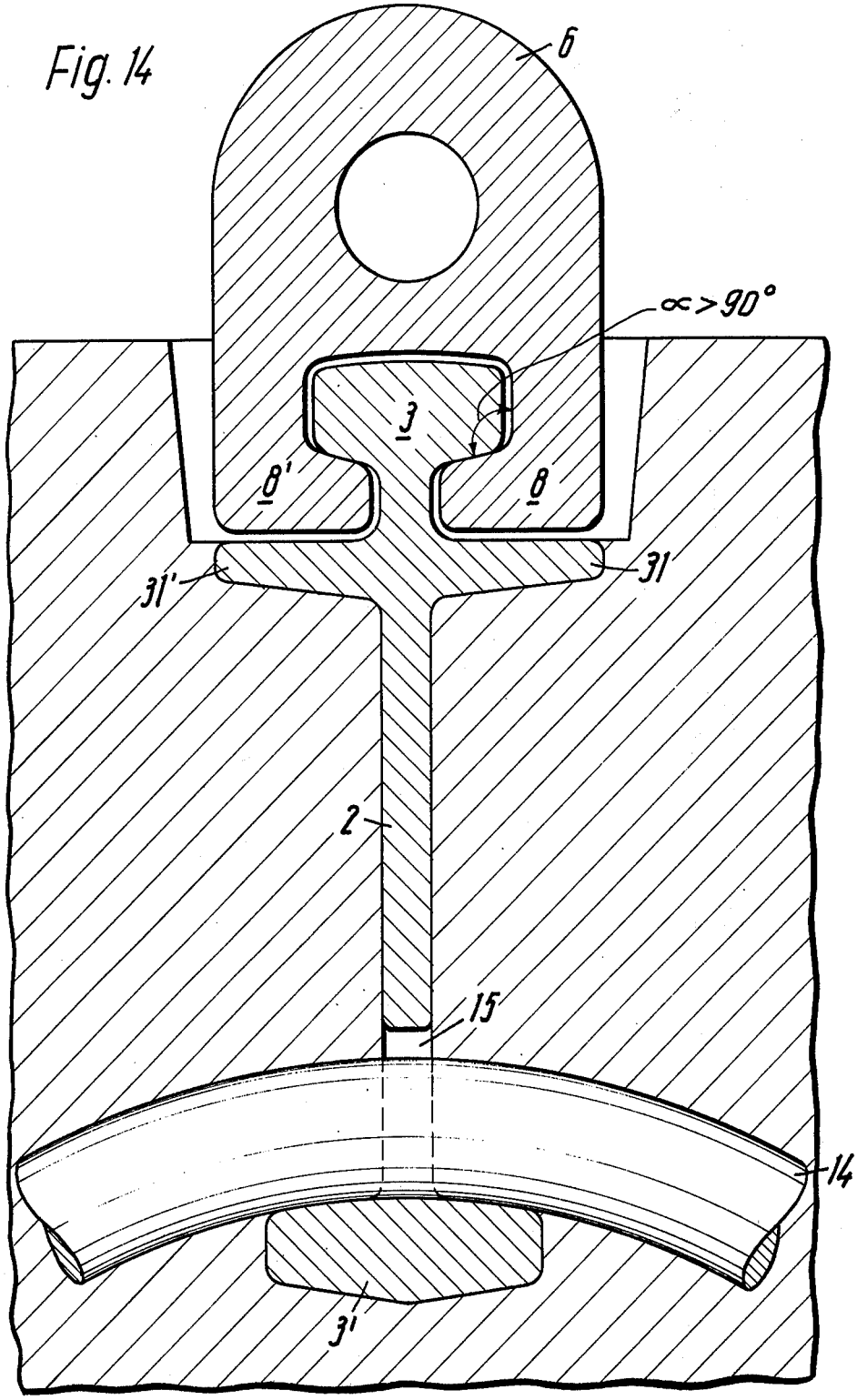
FIGS. 14 and 15 are section views through anchoring and coupling arrangements with somewhat modified construction features.

FIG. 14 shows a somewhat modified anchoring construction which, however, could be used in the assemblies of FIGS. 8 through 13. The bar or ridge 2 of the anchoring member is provided here with two flanges 31 and 31' which are not completely embedded in the concrete, but together with head 3 they establish a groove in which the lips or edge members 8, 8' of suspension member 6 are received. The edge members 8 and 8' do not all face any concrete but they face the exposed surfaces of flanges 31, 31' respectively. If lateral forces are applied to coupling member 6, one or the other edge member engages also flange 31 or 31' as the case may be.

Upon such tilting of coupling member 6, and upon engagement of one of the edge portions of coupling member 6 with one or the other flange, 31 or 31', forces are not only applied normally to the concrete bottom surface of the groove, but the flange, 31 or 31' reacts additionally such forces into the ridge 2, normally, i.e. straight down and deep into the concrete. Thus, wear of edges of any concrete or any point like exertion of forces upon the concrete is duly avoided.

Figure 15:
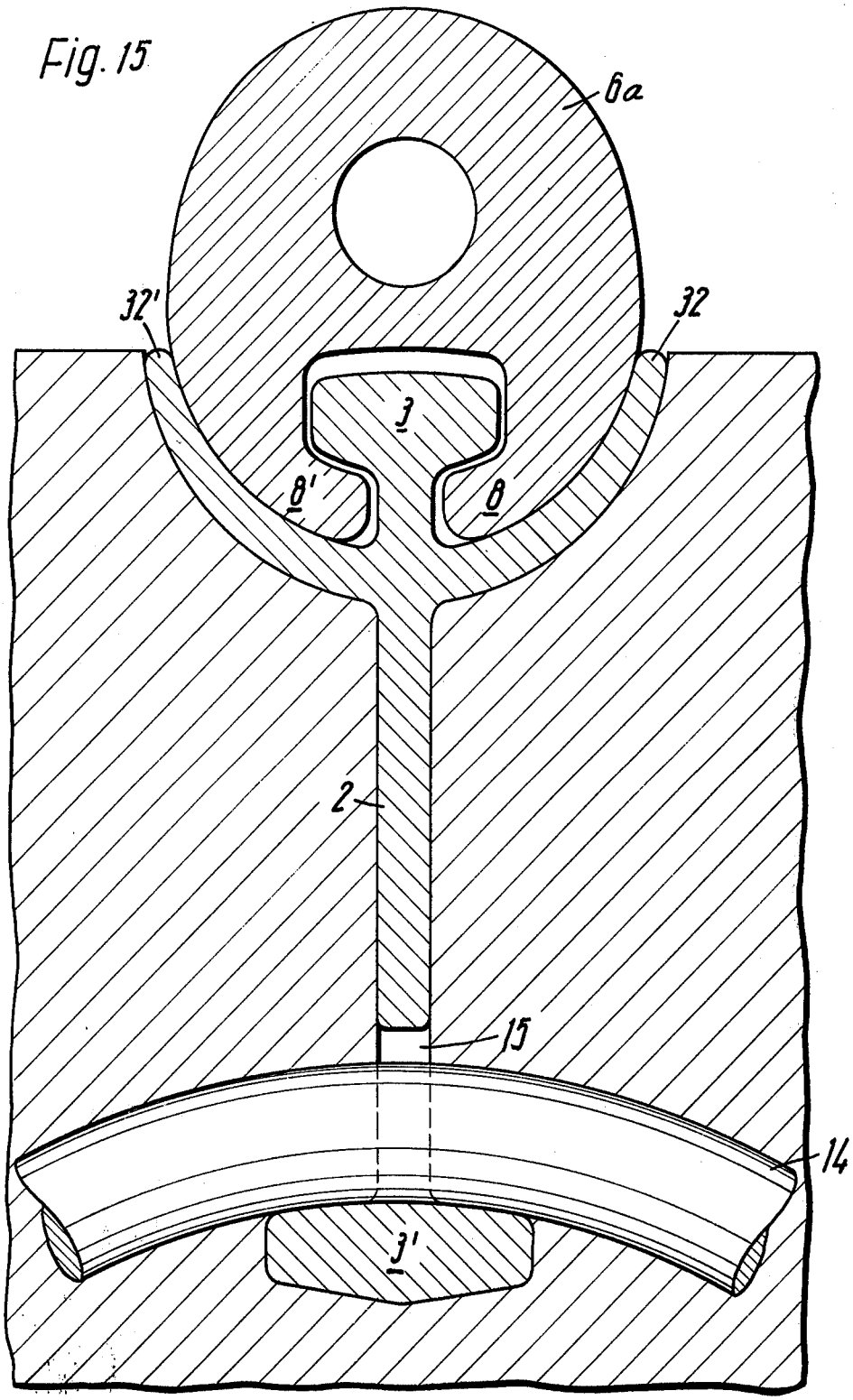

FIG. 15 shows flanges 32, 32' on ridge 2 which have curved configuration offering a concave surface to a correspondingly convex shaped suspension and coupling member 6*a*. This way the flanges establish a curved friction bed in which member 6*a* can undergo limited turning when acted upon by forces having a lateral component. The matching convex-concave contours of member 6 and of the flanges 32, 32' make also certain that any force interaction of the concrete occurs only normal to the concrete surface.

The upwardly bent flanges 32, 32' provide for an additional function. They prevent flow of liquidous concrete into the space below the head 3 so that the receiving space for edge members 8, 8' will not be obstructed by hardened concrete. The general rule here is that the curved (or, possibly, bent up) portion of flanges 32, 32' should extend up at least as high as the lower surfaces of head 3; so that the grooves as defined by head 3, by the upper portion of ridge 2 and by the two flanges 32, 32' are indeed protected against inflow of concrete.

Figure 16:
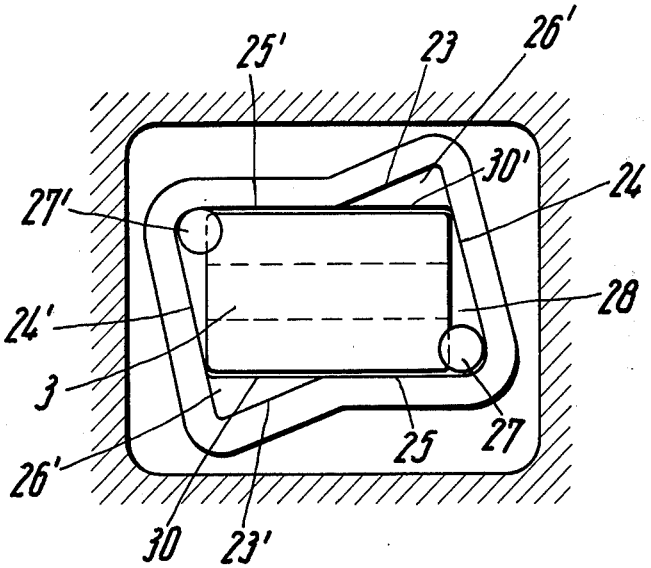
FIGS. 16 and 17 are two top views of the same coupling arrangement but in different relative positions of a particular and modified coupling member.
Figure 17:
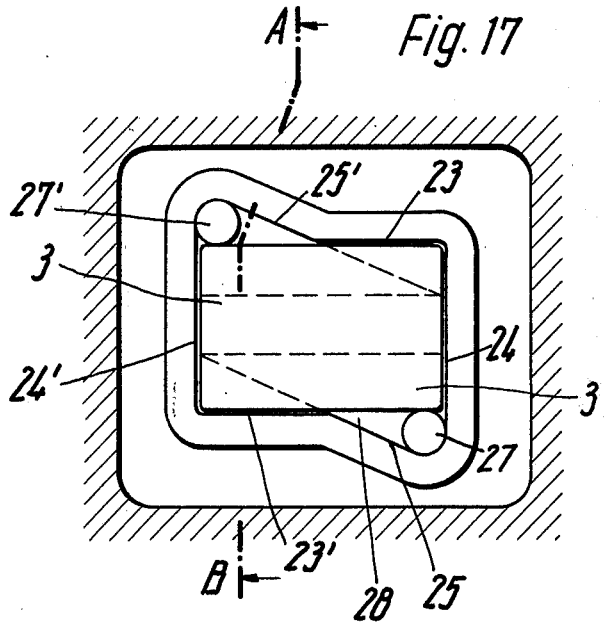
Figure 18:
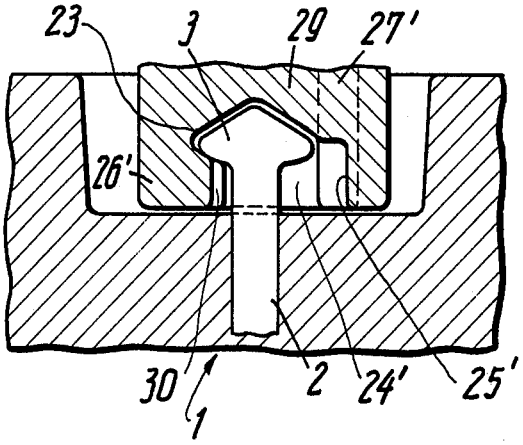
FIG. 18 is a section view along line A—B in FIG. 17.

Turning now to FIGS. 16, 17 and 18, these Figures refer to the same coupling and anchoring assembly but the FIGS. 16 and 17 show that assembly in different states of orientation in relation to an axis extending transversely to the plane of the drawing of these two figures.

The coupling member 29 in this case has an opening 28 for receiving an anchoring head 3 constructed as described earler. The inner surfaces and boundaries 23, 23′ and 24, 24′ and 25, 25′ of the hollow coupling element are parallel to each other, in pairs, whereby surfaces 23 and 24 as well as surfaces 24′ and 23′ intersect at right angles. The opening 28, through which the head 3 is inserted, is bounded by the surfaces 24, 24′, 25, 30, 25′ and 30′ amd has configuration of a parallelogram. The surface portion 30 is a colinear continuation of surface portion 25, and surface portion 23′, which is angled off surface portion 25, forms a ledge, edge projection or shoulder 26 when taken surface 30. Analogously, the lower surface portion 30′ is a colinear continuation of surface portion 25′, and surface portion 23 which is angled off surface portion 25′ and taken with surface 30′ forms a second shoulder, ledge or edge projection 26.

As can be seen in cross-section of FIG. 18, ledge or edge 26′ has an inner engaging surface which has an angle of larger than 90° to the vertical which is the direction of extension of that portion of coupling member 29 which extends down from the upper base. The shoulders 26 and 26′ are slightly concavely curved.

In order to establish coupling relation between anchoring member 1 and coupling element 29, the latter is shifted onto the head 3 of member 1, thereby passing through opening 23 whereby the long head sides extend parallel to the long sides 25–30 and 25′, 30′ of the parallelogram. The passing disposition is shown in FIG. 16. After the head has been inserted so that the lower sides clear the ledges 26, 26′, the coupling member 29 is turned which leads to the relative disposition depicted in FIG. 17.

In the disposition shown in FIG. 17, shoulders 26 and 26′ of coupling member 29 reach under head 3. These projections 26 and 26′ are inwardly directed in the range of opening 28 and extend respectively between inner surfaces 23, 24 and 23′ 24′.

Anti-rotation locks 27, 27′ are provided in the hollow interior of coupling element 29 and respectively between surfaces 24, 25 and 24′, 25′. These locks are moved into locking position when projections or shoulders 26, 26′ have lodged under head 3. These locks prevent subsequent decoupling of members 29 and 1. Locks 27 and 27′ are preferably constructed as drop pins which are actuated from the exterior of member 29. It can be seen that pins 27, 27′ appear to fall through opening 28, but they actually may rest on the concrete bed from which the head 3 projects. These pins, however, are only an example, other locks for preventing turning of the elements 29 and 1 relative to each other can be provided for.

After members 29 and 1 have been locked as described, the coupling assembly provides for connection between a transport means, such as chain and the concrete or other stone part in which anchoring member 1 is partially embedded. The locks will be released when decoupling is desired and element 29 is turned back until projections 26, 26′ clear head 3 whereupon member 29 can be removed entirely from anchoring member 1.

From the foregoing examples one can readily see that the invention provides for a very versatile coupling and suspension structure for artificial stone parts. Even though different kinds of profiled anchoring members are shown, one really needs only one kind, irrespective of the weight which will be and has to be supported and irrespective of a conceivably large weight range.

The anchoring elements may come as elongated sections and individual sections are cut therefrom; then they are embedded in the not yet solidified stone part and held in position if necessary until the e.g. concrete has solidified. One does not need different kinds of elements, particularly if facilities are available to bend sections into shapes such as shown in FIGS. 3 or 4.

After the stone part has sufficiently hardened, a suspension and coupling member of the variety outlined above can be laterally slipped onto the anchoring member, particularly to receive the head of the latter. Moisting and lifting means are then attached and linked to the coupling member. Upon lifting the stone part as now coupled to the lifting device, it makes little difference whether the resulting forces as acting between coupling and anchoring surrounding of the members 1 change direction, because of the convex-concave interface between coupling member and anchoring member. This way all faces are reacted straight into the stone material.

One can further see that the anchoring and coupling arrangement can be used not only for and during transport of the stone parts, but also for their erection, orientation and even for final installation. The latter operation may require more or additional couplings than needed for transporation, but more of the couplings are unreleasable. One can also see that either plural anchoring members provided as several small sections can be used with a corresponding plurality coupling member, or one uses one elongated type anchoring member for a certain length of the stone. Relatively short coupling members may then be used, one or some for connection to the transport device; one or others may be used for installation aids such as the erection and orienting equipment of FIG. 8, but they all use the same anchoring member.

It should be noted that different configurations of the anchoring members were explained above, but any one of the configurations is applicable to various kinds of uses and particularly to different plates covering a large range of weights.

The invention is not limited to the embodiments described above but all changes and modifications thereof not constituting departures from the spirit and scope of the invention are intended to be included.

I claim:

1. Coupling structure, wherein part of the coupling is an anchoring member being embedded in an artifical stone part such as a siding or a plate made of concrete or other stone material that permits embedding of anchoring members, comprising:

an anchoring member constructed as profiled section extending in a first direction and having similarly contoured cross-sections in planes transverse to the first direction, the member having a flat stem portion with flatness also extending in the first direction and longer than the stem portion is thick, the stem portion being partially embedded in the stone part material and projecting above a flat surface portion of the stone part, the member having a head extending lengthwise in the first direction as well as laterally from the flat stem in a profiled contour in the said planes, the head having convex surface portion where laterally extending from the stem, the head being on a portion of the stem that projects above the said stone part surface;

a coupling member constructed as a profile bar with C-shaped cross-section and extending in a particular direction and having a base, a pair of side flanges having also lengthwise extension in the particular direction but extending from the base, transverse to the particular direction, and edges extending from the flanges towards each other, but leaving clearance space wider than the said stem portion is thick thereby defining a straight slot with predominant extension in the particular direction, for passage of the said stem portion of the anchoring member as the head of the anchoring member is being received by the C-space as defined by the base and the side flange, whereby the first direction runs parallel to the particular direction, each of the edges having a flat lower, outer surface extending from the slot to the respective flange from which the edge extends;

said coupling member as receiving the head being capable of limited angular displacement in said transverse planes and with a tilt axis parallel to said first and particular directions upon tilting one or the other of said edges abutting said stem laterally from one or the opposite side, limiting said angular displacement accordingly, the head of the anchoring member extending above the said stone part surface only, so that upon application of skewed pulling force upon the coupling member the lower outer surface portion of the one edge bearing against said flat surface portion of the stone material, as the one edge abuts the stem, while the lower outer surface of the edge which does not abut the stem, is raised above said surface portion; and the edges having concavely shaped inner shoulders corresponding to the convex surface portion of the head and extending lengthwise in the particular direction, but for an angle larger than 90° from the respective flanges in a plane transverse to the particular direction, the said two concave shoulders being always respectively in engagement with the said convex surface portions of the head when the anchoring member is suspended from the coupling member, the head extending from the stone part so that the said lower edge surfaces clear the said surface portions of the stone part.

2. Coupling structure as in claim 1, the anchoring member being provided with two heads.

3. Coupling structure as in claim 2, the second head being embedded in the stone material.

4. Coupling structure as in claim 2, the anchoring member being angled so that the heads project in different directions.

5. Coupling structure as in claim 4, the two heads emerging from the stone part in differently oriented surfaces of the part.

6. Coupling structure as in claim 2, the anchoring member being doubly angled so that the heads project in different directions.

7. Coupling structure as in claim 1 including wire loop means enveloping the ridge in the interior of the stone part and being embedded therein.

8. Coupling structure, wherein part of the coupling is an anchoring member being embedded in an artificial stone part such as a siding or a plate made of concrete or other stone material that permits embedding of anchoring members, comprising:

an anchoring member constructed as profiled section extending in a first direction and having similarly contoured cross-sections in planes transverse to the first direction, the member having a flat stem portion with flatness also extending in the first direction and longer than the stem portion is thick, the stem portion being partially embedded in the stone part material and projection above a flat surface portion of the stone part, the member having a head projecting above the said stone part surface portion and extending lengthwise in the first direction and laterally thereto from the flat stem;

a coupling member constructed as a profile bar with C-shaped cross-section and extending in a particular direction and having a base and means, including sides, for defining a cavity with an elongated opening opposite the base, the head of the said member being inserted in said cavity;

edges projecting from the sides of the coupling member into the opening to define support shoulders which extend parallel to the extension of the head as inserted each for engagement with at least a portion of the lower surface portions of the head at both sides from the stem and extending lengthwise into the particular direction, the shoulders having angle of more than 90° in a plane transverse to the particular direction to the sides of the coupling member, the coupling member being laterally closed by at least three sides, the edges each having a flat outer, lower surface clearing the said stone part surface when the head is suspended by engagement with both said support shoulders; and the stem being thinner than a distance between the edges so that said coupling member as receiving the head is capable of limited angular displacement in said transverse planes and with a tilt axis parallel to said first and particular directions whereby one or the other of said edges abuts said stem laterally from one or the opposite side, limiting said angular displacement accordingly, the head of the anchoring member extending above the said stone part surface only so that upon application of skewed pulling force upon the coupling member the lower outer surface portion of the one edge bears against said flat surface portion of the stone material, while the lower outer surface of the edge which does not abut the stem, is raised above said surface portion upon application of skewed pulling force upon the coupling member.

9. Coupling structure as in claim 8, wherein the edges extend parallel to each other and have at least approximately uniform width as to the said shoulder.

10. Coupling structure as in claim 9, wherein the edges extend parallel to each other but have triangular contour in a projection taken in the said direction.

11. Coupling structure as in claim 10, wherein the flanges are contoured to have a portion in line with one side of the triangular contour of the ridges, an adjacent portion being in line with another side of the triangular contour, so that a head or an anchoring member can be inserted into the coupling member and upon mutual rotation rest behind the said edges, there being rotation preventing means in the coupling member to lock the head behind the said edges.

* * * * *